United States Patent [19]

Ito et al.

[11] Patent Number: 4,945,386

[45] Date of Patent: Jul. 31, 1990

[54] COPIER WITH MAGNIFICATION SELECTION AND PAPER WINDING PREVENTION

[75] Inventors: Masazumi Ito; Yoshihiro Horie, both of Osaka, Japan

[73] Assignee: Minolta Camera Kabushiki Kaisha, Osaka, Japan

[21] Appl. No.: 323,627

[22] Filed: Mar. 14, 1989

[30] Foreign Application Priority Data

Mar. 16, 1988 [JP] Japan ..... 63-63804

[51] Int. Cl.[5] ..... G03G 15/00

[52] U.S. Cl. ..... 355/243; 355/218; 355/319

[58] Field of Search ..... 355/243, 319, 320, 313, 355/314, 218

[56] References Cited

U.S. PATENT DOCUMENTS

| | | | |
|---|---|---|---|
| 4,260,242 | 4/1981 | Nishikawa | 355/210 |
| 4,451,136 | 5/1984 | Tanioka | 355/210 |
| 4,501,490 | 2/1985 | Miyamoto | 355/55 |
| 4,721,381 | 1/1988 | Matsuo | 355/319 X |
| 4,740,810 | 4/1988 | Ito | 355/56 |
| 4,752,809 | 6/1988 | Ito | 355/243 X |
| 4,801,975 | 1/1989 | Kano et al. | 355/218 |
| 4,819,029 | 4/1989 | Ito | 355/218 |
| 4,831,413 | 5/1989 | Hamakawa | 355/243 X |
| 4,849,789 | 7/1989 | Ito et al. | 355/218 |

*Primary Examiner*—A. C. Prescott

*Attorney, Agent, or Firm*—Willian Brinks Olds Hofer Gilson & Lione

[57] ABSTRACT

Magnification is selected in response to selection of simplex or duplex mode. Then an original image is scanned by an optical system with the predetermined magnification and formed as an electrostatic latent image on a photoreceptor drum. Other latent images on the photoreceptor drum than the above mentioned electrostatic latent image, which correspond to a leading edge area and a rear edge area of the original image, are erased by an interimage eraser. Since toner does not adhere to the areas thus erased, toner is not transferred onto the leading and rear edge areas of the copy paper. Accordingly, when the transferred image on the copy paper is fixed by a fixing roller, the leading edge portion of the copy paper does not adhere to the roller and consequently, the copy paper can be prevented from winding around the roller.

7 Claims, 14 Drawing Sheets

COPIER WITH MAGNIFICATION SELECTION AND PAPER WINDING PREVENTION

CROSS-REFERENCE TO RELATED, COPENDING APPLICATION

Related, copending application of particular interest to the instant application is U.S. Ser. No. 238,843, entitled "Copying Apparatus Having a Binding Margin Forming Function", filed Aug. 31, 1988 and assigned to the same assignee of the instant application.

BACKGROUND OF THE INVENTION

1. Field of the Invention

The present invention relates to a copying apparatus and particularly to a copying apparatus in which a toner image based on an image of an original is transferred onto copy paper and fixed.

2. Description of the Related Art

A copying apparatus is provided with a fixing device for fixing a toner image transferred on copy paper.

FIGS. 11A and 11B are enlarged views of a fixing roller portion.

Referring to those figures, the fixing device comprises a heating roller 5*a* containing a heater for example, a pressing roller 5*b* which rotates in contact with the heating roller by applying pressure thereto, and separation claws 150*a* and 150*b* for separating copy paper P passing through the fixing roller portion, from the rollers 5*a* and 5*b*. Normally, when the copy paper P passes between the rollers 5*a* and 5*b*, toner of a transferred image FP is pressed and thermally fused on the copy paper and fixed thereon. The copy paper P having the image fixed thereon is separated and discharged from the rollers 50*a* and 50*b* by means of the separation claws 150*a* and 150*b*.

However, since the melted toner has some viscosity, if a black solid image exists in a leading edge portion of the copy paper, the copy paper would wind about the heating roller 5*a*.

More specifically, if the transferred image FP is formed as far as the leading edge portion of the copy paper P as shown in FIG. 11B, the copy paper P passes through the rollers with the leading edge of the copy paper P adhering to the heating roller 5*a* due to the melted toner. On the other hand, there is a certain gap between the separation claws 150*a* and 150*b* and the rollers 5*a* and 5*b*, respectively, so that the rollers may rotate smoothly. Accordingly, the copy paper P is not separated by the separation claw 150*a* and it winds about the heating roller 5*a*.

Particularly, in a copying apparatus having a duplex copy function of executing copy on both surfaces of copy paper, two copy operations are required for one sheet of copy paper. More specifically, copy paper fed from a feed opening is transported to an intermediate tray and stored temporarily therein after the first copy operation and then it is refed from the intermediate tray so that the second copy operation is performed.

Accordingly, in the case of duplex copying, one sheet of copy paper passes through the fixing device twice and the leading and rear edges of the copy paper passing through the fixing device are interchanged. In consequence, in the case of duplex copying, toner at the leading edge and that at the rear edge of the copy paper cause the paper to wind about the roller and also cause fouling of the rollers or the copy paper.

SUMMARY OF THE INVENTION

An object of the present invention is to prevent copy paper from winding, about a fixing unit in a copying apparatus.

Another object of the present invention is to prevent copy paper from winding about a fixing unit at the time of duplex or composite copying in a copying apparatus.

Still another object of the present invention is to prevent copy paper from winding about a fixing unit without causing any deficiency in an image in a copying apparatus.

A further object of the present invention is to prevent copy paper from winding about a fixing unit at the time of duplex or composite copying causing any deficiency in an image in a copying apparatus.

In order to attain the above described objects, a copying apparatus according to the present invention generally includes: a photoreceptor, image forming means for forming a toner image on the photoreceptor, transfer means including a transfer portion for transferring the toner image formed on the photoreceptor onto copy paper, fixing means for thermally fixing the toner image transferred on the copy paper, and duplex means for feeding again the copy paper having the thermally fixed image to the transfer portion to form images on both surfaces of the copy paper, and the copying apparatus further includes mode selecting means, first means, second means and control means. The mode selecting means selects a duplex mode for forming images on both surfaces of copy paper and a simplex mode for forming an image on one surface of copy paper. The first means forms a margin at a leading edge of copy paper. The second means forms margins at leading and rear edges of copy paper. The control means enables the first means in response to selection of the simplex mode and enables the second means in response to selection of the duplex mode.

In order to attain the above described objects, a copying apparatus according to an aspect of the present invention includes: a photoreceptor, image forming means for forming a toner image, which corresponds to an original, on a photoreceptor with a selected magnification, transfer means for transferring the toner image formed on the photoreceptor onto copy paper, fixing means for thermally fixing the toner image transferred on the copy paper, and duplex means for feeding again the thermally fixed copy paper to the transfer means to form images on both surfaces of the copy paper, and the copying apparatus further includes mode selecting means, first means, second means and control means. The mode selecting means selects a duplex mode for forming images on both surfaces of copy paper and a simplex mode for forming an image on one surface of copy paper. The first means forms a margin at a leading edge of copy paper. The second means forms margins at leading and rear edges of copy paper. The control means enables the first means and selects a first magnification in response to selection of the simplex mode and enables the second means and selects a second magnification in response to selection of the duplex mode.

In the copying apparatus thus constructed, a margin is formed at the leading edge of the copy paper and accordingly it becomes possible to prevent winding of the copy paper about the fixing roller, which would be liable to occur in a conventional apparatus at the time of fixing a toner image transferred on copy paper.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
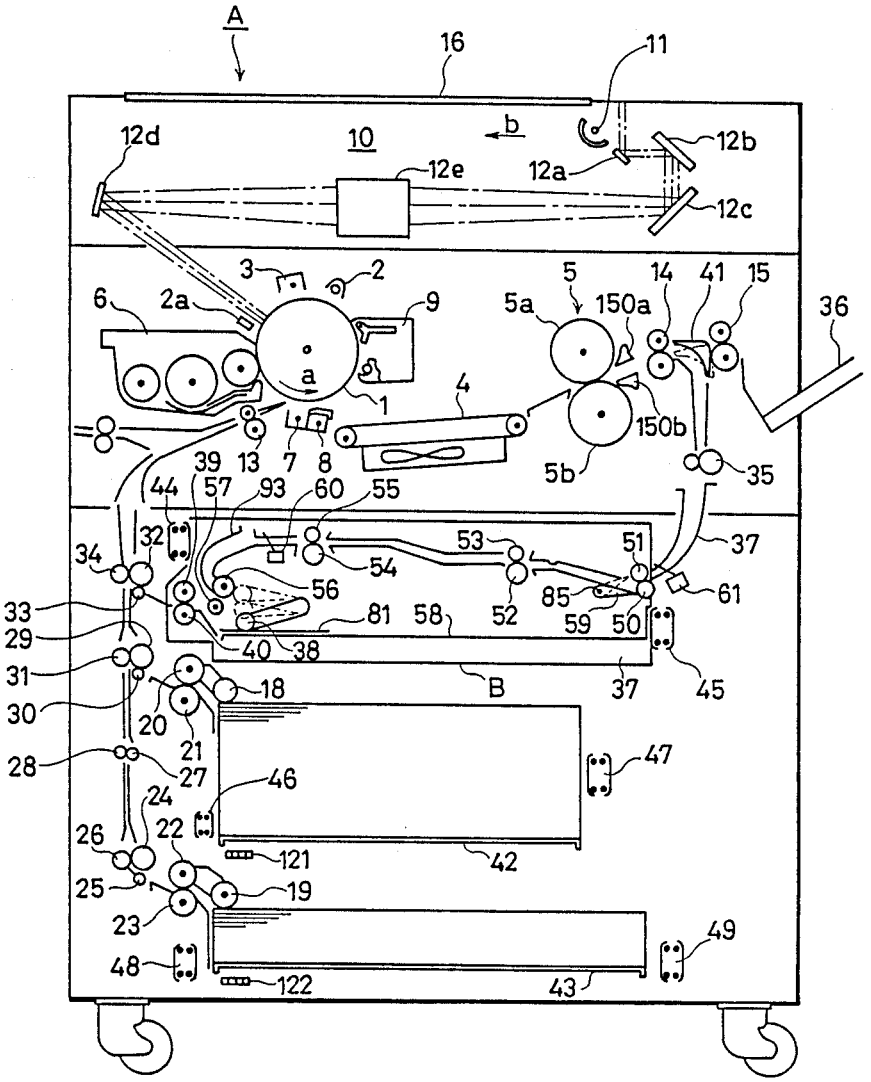
FIG. 1 is a front sectional view showing a construction of a copying apparatus according to an embodiment of the present invention.

Referring to the drawings, an embodiment of the present invention will be described.

FIG. 1 is a front sectional view showing a construction of a copying apparatus A.

The copying apparatus A comprises: a copy paper storing portion, a copy paper feeding unit, and an intermediate tray unit B just above the copy paper storing portion in its lower portion; an image forming unit including a photoreceptor drum 1 in its intermediate portion; and an optical system 10 in its upper portion. Copy paper on which a first copy has been effected is fed to the intermediate tray unit B and temporarily stored therein and then it is refed, whereby a duplex copy or a composite copy can be effected.

Referring to FIG. 1, an eraser lamp 2, a corona charger 3, an interimage eraser **2*a* including an LED array, a developing unit 6, a transfer charger 7, a separation charger 8 and a cleaning unit 9 of a blade type are arranged around the photoreceptor drum 1. The photoreceptor drum 1 has a photoreceptive layer on its surface and when it passes by the corona charger 3, it is uniformly charged and then it is subjected to exposure of an image from the optical system 10**.

The optical system 10 is located under an original platen glass 16 to scan an original image and it comprises an exposure lamp 11, movable mirrors **12*a* to 12*c*, a lens 12*e* and a mirror 12*d*. The exposure lamp 11 and the movable mirror 12*a* are driven by a scanning motor, not shown, to move at a speed v/n (n being a copying magnification) with respect to the rotation speed v of the photoreceptor drum 1 and the movable mirrors 12*b* and 12*c*** are driven by the scanning motor to move at a speed v/2n.

The copy paper storing portion comprises an upper storing unit 42 of an elevator type and a lower storing unit 43 of a cassette type. Each of the storing units can be drawn out toward the front side from the main body of the copying apparatus by means of the rails 46 and 47 and the rails 48 and 49.

The storing units 42 and 43 are provided with size sensors 121 and 122, respectively, for detecting a size of copy paper. The size sensors 121 and 122 comprise for example a plurality of switches provided in the main body of the copying apparatus and a plurality of permanent magnets provided in the storing units 42 and 43, respectively, for selectively operating those switches according to the size.

Either the sheets of copy paper in the storing unit 42 through rotation of a feed roller 18 or the sheets of copy paper in the storing unit 43 through rotation of a feed roller 19 are selectively delivered and fed one by one by means of rollers 20 and 21 or rollers 22 and 23. The fed copy paper is transported to a timing roller pair 13 through transport rollers 29 to 31 or 24 to 26 and rollers 32 and 34 or 27 and 28.

The copy paper is temporarily stopped by the timing roller pair 13 and then it is sent to a transfer position in synchronization with a toner image formed on the photoreceptor drum 1. In that position, the toner image is transferred onto the copy paper by means of the transfer charger 7 and the copy paper is separated from the surface of the photoreceptor drum 1 by means of the separation charger 8. Then, it is sent to the fixing device 5 by means of the transport belt 4, so that the transferred toner is fixed.

The fixing device 5 comprises a heating roller **5*a* containing a heater, a pressing roller 5*b* which rotates in contact with the heating roller 5*a* by applying pressure thereto, and separation claws 150*a* and 150*b* which separate the copy paper having the fixed toner image from the rollers. The copy paper passes through the rollers 5*a* and 5*b***, whereby the toner is pressed and thermally fixed on the copy paper.

A lever 41 for changing a transport path for the copy paper is provided between a transport roller pair 14 and a discharge roller pair 15 which are provided on the output side of the separation claws **150*a* and 150*b* of the fixing device 5**.

If the copy paper is to be discharged directly, the lever 41 is set to a position shown by the dotted lines in FIG. 1 and the copy paper transported from the fixing device 5 is discharged onto a tray 36 from the discharge roller pair 15. In the case of executing duplex copying or composite copying the lever 41 is set to a position shown by the solid lines in FIG. 1 and the copy paper is sent into the intermediate tray unit B from the transport roller pair 35 through guide plates 37.

In the meantime, residual toner on the photoreceptor drum 1 after the transfer operation is removed therefrom by the cleaning device 9 and residual electrical charge thereon is removed by application of light from the eraser lamp 2, whereby the apparatus is prepared for the next copy process.

The intermediate tray unit B is supported in the main body of the copying apparatus by means of rails 44 and 45 and it can be drawn out to the front side (to the direction of the paper surface of FIG. 1) from the main body of the copying apparatus, namely, perpendicularly to the feeding path of the copy paper.

Figure 2:
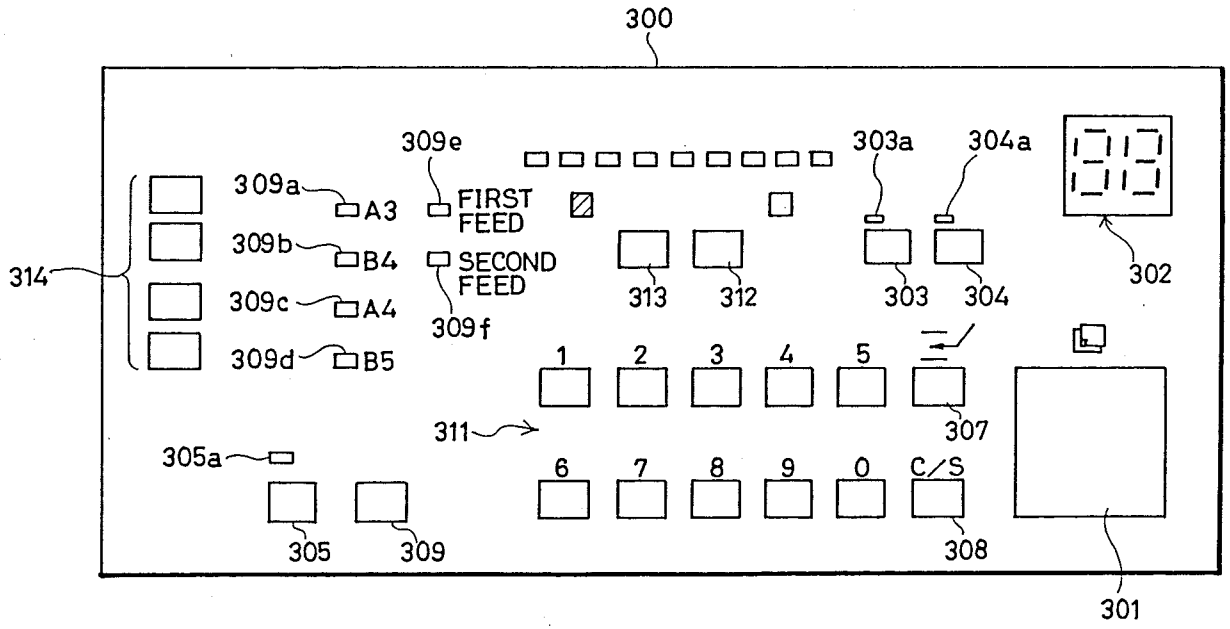
FIG. 2 is a plan view of an operation panel of the copying apparatus of FIG. 1.

In the case of duplex or composite copying, the selection key 303 or 304 on the operation panel 300 shown in FIG. 2 is pressed, whereby either copy mode is selected and the selection lever 41 is set to the position shown by the solid lines in FIG. 1. The copy paper having a copy image on one surface is guided through the guide plates 37 from the transport roller pair 35 to the transport rollers 50 and 51.

A selection lever 59 is rotatable about a shaft 85 and it is set to the side of the lower transport roller 50 (as shown by solid lines in FIG. 1 in the case of duplex copying. The copy paper is guided along the upper surface of the lever 59 and transported leftward in the figure by means of transport rollers 52, 53 and 54, 55. Then, it is reversed by reverse transport rollers 56 and 57 and a reverse guide 93 and it is placed on an intermediate tray 58 with the surface having the copy image being directed upward. Then, the sheets of copy paper are registered on the intermediate tray 58 by a registration mechanism and those sheets are refed one by one by counterclockwise rotation of a refeed roller 38.

In the case of composite copying, the above mentioned selection lever 59 is set to the side of the upper transport roller 51 (shown by chained lines in FIG. 1) and the copy paper having passed through the transport rollers 50 and 51 is guided along the lower surface of the lever 59 and transported directly onto the intermediate tray 58 with the surface having the copy image being directed downward. Then, the sheets of copy paper are registered on the intermediate tray 58 by the registration mechanism and they are refed one by one by counterclockwise rotation of the refeed roller 38 in the same manner as in the case of duplex copying.

The refed copy paper is delivered through the delivery rollers 39 and 40 and transported to the timing roller through the tra rollers 32 to 34. Then, duplex copying or composite copying is effected on the copy paper in the same manner as in a normal copy process.

FIG. 2 shows an arrangement of operation keys and the like on the operation panel 300 of the copying apparatus A.

The operation panel 300 comprises: a print start key 301 for starting copy operation; a display 302 formed by 7-segment LEDs for displaying the number of copies; a ten-key group 311 consisting of ten-keys corresponding to numerical values from 1 to 0; an interruption key 307 for designating an interruption copy; a clear stop key 308; a paper selection key 309 for selecting either the copy paper storing unit 42 or 43; size display LEDs **309*a* to 309*d* for displaying a size of paper stored in the selected storing unit; a first paper feed selection display LED 309*e* for indicating selection of the first paper feed (the storing unit 42); a second paper feed selection display LED 309*f* for indicating selection of the second paper feed (the storing unit 43); an up key 312 and a down key 313 for changing and designating a density of a copy image by steps; magnification selection keys 814 for selecting a copying magnification by steps; a duplex copy selection key 303; a duplex copy mode selection display LED 303*a* for indicating selection of duplex copy; a composite copy selection key 304; a composite copy mode selection display LED 304*a* for indicating selection of composite copy; an automatic reduction mode selection key 305; and an automatic reduction mode selection display LED 305*a*** for indicating selection of an automatic reduction mode.

Figure 3:
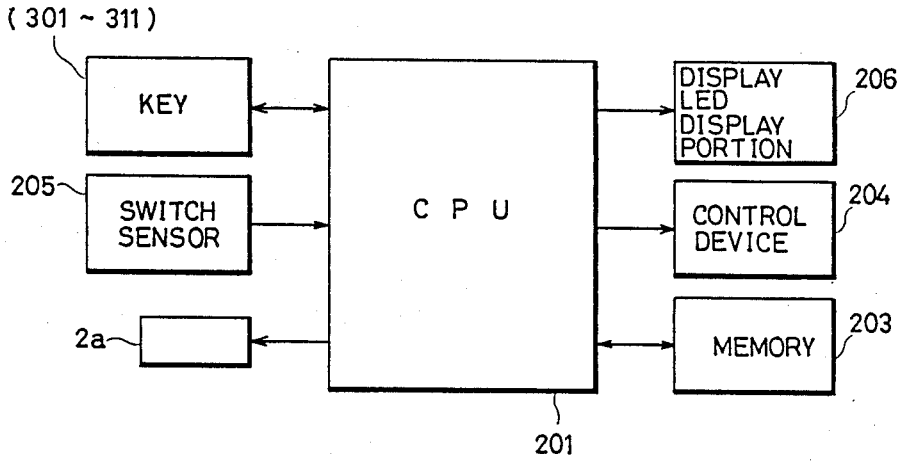
FIG. 3 is a block diagram showing a control circuit of the copying apparatus of FIG. 1.

Those various keys and LEDs as well as various sensors provided in the main body of the copying apparatus and the intermediate tray unit B are connected to a control circuit including a microcomputer as shown in FIG. 3.

FIG. 3 is a block diagram showing the control circuit of the copying apparatus A.

A central processing unit (CPU) 201 comprising a microcomputer is connected with a memory 203 such as a RAM or ROM, the above mentioned interimage eraser **2*a*, various input keys, various display LEDs or display portion 206, various sensors or switches 205 and a control device 204** for a motor, clutches or a fixation heater, through suitable interfaces such as a diode matrix, I0 ports, or switching transistors, or not through such interfaces.

When the automatic reduction mode selection key 305 is pressed to turn on the automatic reduction mode selection display LED **305*a***, blank areas with no toner images are provided at leading and rear edges of copy paper in the first surface copy of the duplex copy mode or a blank area is provided at a leading edge of copy paper in other copy processes.

In the duplex copy mode, a reduction copy magnification is automatically set according to the dimensions of the blank areas so that copying can be effected on the copy paper excluding the blank areas at the leading edge and/or the rear edge without causing any deficiency in the image.

Figure 4:
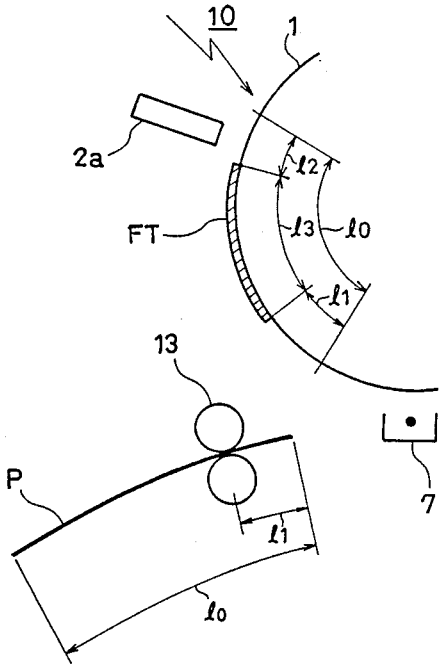
FIG. 4 is an enlarged view showing a peripheral portion of a photoreceptor drum in the copying apparatus of FIG. 1.
Figure 5:
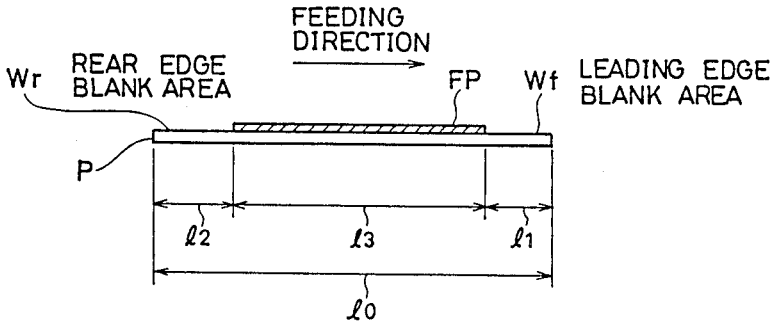
FIG. 5 is a side view of copy paper on which toner has been transferred according to the embodiment of the present invention.

FIG. 4 is an illustration showing a peripheral portion of the photoreceptor drum 1 in an enlarged manner and FIG. 5 is a side view of copy paper P on which an image has been transferred.

Referring to those figures, description will be made of the case of forming a blank area Wf of a dimension $l_1$ and a blank area Wr of a dimension $l_2$ at each of the leading and rear edges of copy paper P, respectively, with the length of the copy paper P and the length of an original being both $l_0$.

Referring to FIG. 4, the leading edge of the copy paper P in contact with the timing roller pair 13 projects from the timing roller pair 13 by the dimension $l_1$ by rotation of the timing roller pair 13 for a specified period.

On the other hand, the photoreceptor drum 1 is exposed to light from the optical system 10 and a latent image of an original image is formed on the surface of the drum 1. Then, the photoreceptor drum is subjected to development by the developing device 6, whereby a toner image is formed. In the automatic reduction mode, the latent images on the leading edge area $l_1$ and the rear edge area $l_2$ are erased by the interimage eraser **2*a*** with respect to the total length $l_0$ of the original and no toner image is formed on those areas.

A toner image FT reduced with a magnification ($l_3/l_0$) from the original image is formed on an area $l_3$ defined between the leading edge area $l_1$ and the rear edge area $l_2$.

The timing roller pair 13 is rotated with timing enabling the leading edge of the toner image FT to reach a suitable position from the position of FIG. 4 as a result of rotation of the photoreceptor drum 1, whereby the leading edge of the copy paper P coincides with the leading edge of the are $l_0$ on the photoreceptor drum 1, at the transfer position. As a result, the leading edge blank area Wf, the transferred image FP corresponding to the toner image FT and the rear edge blank area Wr are formed in this order on the copy paper P as shown in FIG. 5.

Figure 11A:
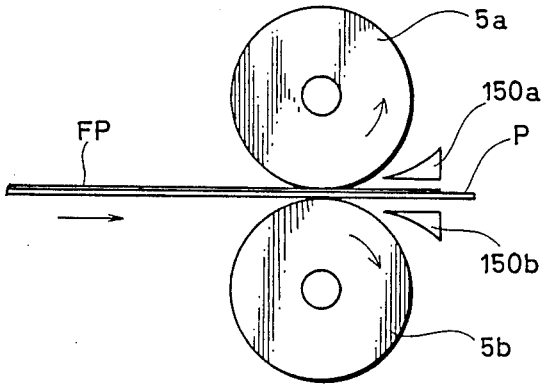
FIG.11A PRIOR ART
FIGS. 11A and 11B are enlarged views of general fixing rollers.
Figure 11B:
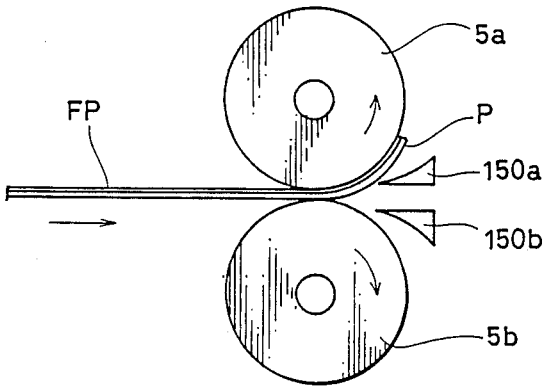
FIG.11B PRIOR ART

In consequence, although the copy paper P is thereafter sent to the fixing device 5 for fixation, it does not wind around the heating roller 5*a* and the heating roller 5*a* and the pressing roller 5*b* are not fouled by toner. This is because the transferred image FP is not formed on the leading edge of the copy paper P as is evident compared with FIG. 11B. In addition, when copying is effected on another surface of the copy paper P in a back surface copy process of the duplex copy mode, a blank area is formed in the same manner and accordingly the copy paper P does not wind around the roller.

Furthermore, since the whole of the toner image FT is formed in a reduced form from the original image, there is no deficiency in the image FP on the copy paper P and the original image can be reproduced completely.

If only the leading edge blank area Wf is formed and the rear edge blank area Wr is not formed, erasure on the rear edge area $l_2$ is not effected and the toner image FT of the original image is formed on the area of the dimension $(l_2+l_3)$ with a magnification of $(l_2+l_3)/l_0$.

Magnifications in those cases are shown in Table 1.

In Table 1, it is assumed that the dimension of the leading edge blank area Wf and that of the rear edge blank area Wr are both 5 mm. The mode A is a mode in which the first surface copy of the duplex copy mode is effected (both of the leading edge blank area Wf and the rear edge blank area Wr are formed) and the mode B is another copy mode (in which only the leading edge blank area Wf is formed).

TABLE 1

| copy paper | | toner image length $l_3$ | | magnification | |
|---|---|---|---|---|---|
| size | length $l_0$ | mode A | mode B | mode A | mode B |
| A3 | 420 | 410 | 415 | 0.976 | 0.988 |
| B4 | 364 | 354 | 359 | 0.972 | 0.986 |
| A4 | 297 | 287 | 292 | 0.966 | 0.983 |
| B5 | 257 | 247 | 252 | 0.961 | 0.980 |

If the length of the copy paper P and that of the original are different, the toner image FT is to be formed with a magnification obtained by multiplying the normal magnification defined by those lengths by the corresponding one of the above mentioned magnifications.

Referring now to the flow charts of FIGS. 6 to 10, procedures of the copy operation will be described.

Figure 6:
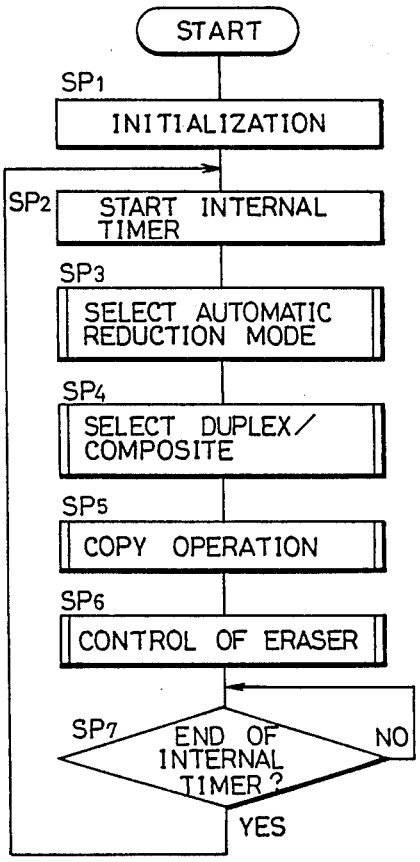
FIG. 6 is a flow chart showing a main routine in the copying apparatus of FIG. 1.

FIG. 6 is a flow chart showing a main routine of the copying apparatus according to the embodiment of the invention.

When the program starts by turn-on of the power supply, the CPU201 is initialized in step SPl and the various modes are set to standard modes. Default values are set to initialize the number of copies, the magnification and the like and all of the parts to be controlled are initialized.

In step SP2, an internal timer for defining a duration of one routine is started.

Then, an automatic reduction mode selection routine (in step SP3), a duplex/composite selection routine (in step SP4), a copy operation routine (in step SP5), and an eraser control routine (in step SP6) are successively executed and after an end of the internal timer in step SP7, the processing flow returns to step SP2.

Figure 7:
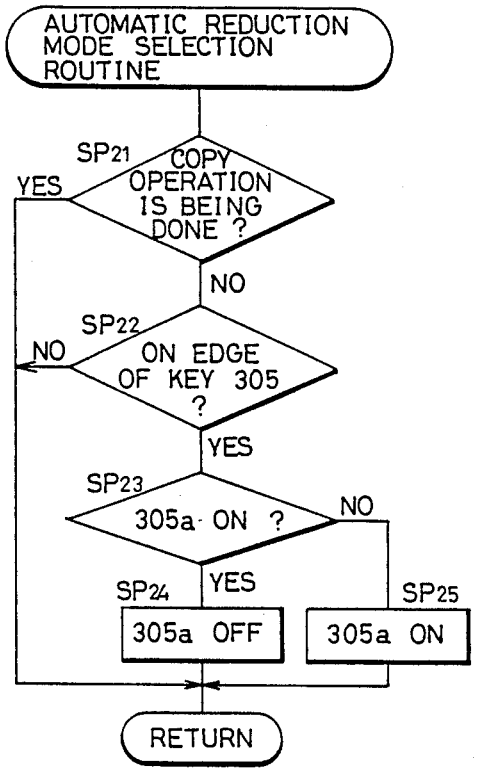
FIG. 7 is a flow chart showing detailed procedures of the automatic reduction mode selection routine in FIG. 6.

FIG. 7 is a flow chart of the automatic reduction mode selection routine in FIG. 6.

First, it is determined in step SP21 whether copy operation is being effected or not. If copy operation is being effected, the flow immediately returns.

If copy operation is not being effected, when the automatic reduction mode selection key 305 is pressed (in the case of YES in step SP22), the automatic reduction mode selection display LED 305*a* is turned off if it is in the on state (in steps SP23 and SP24) and it is turned on if it is in the off state (in steps SP23 and 25). Thus, the display of the automatic reduction mode can be turned on or off.

Figure 8:
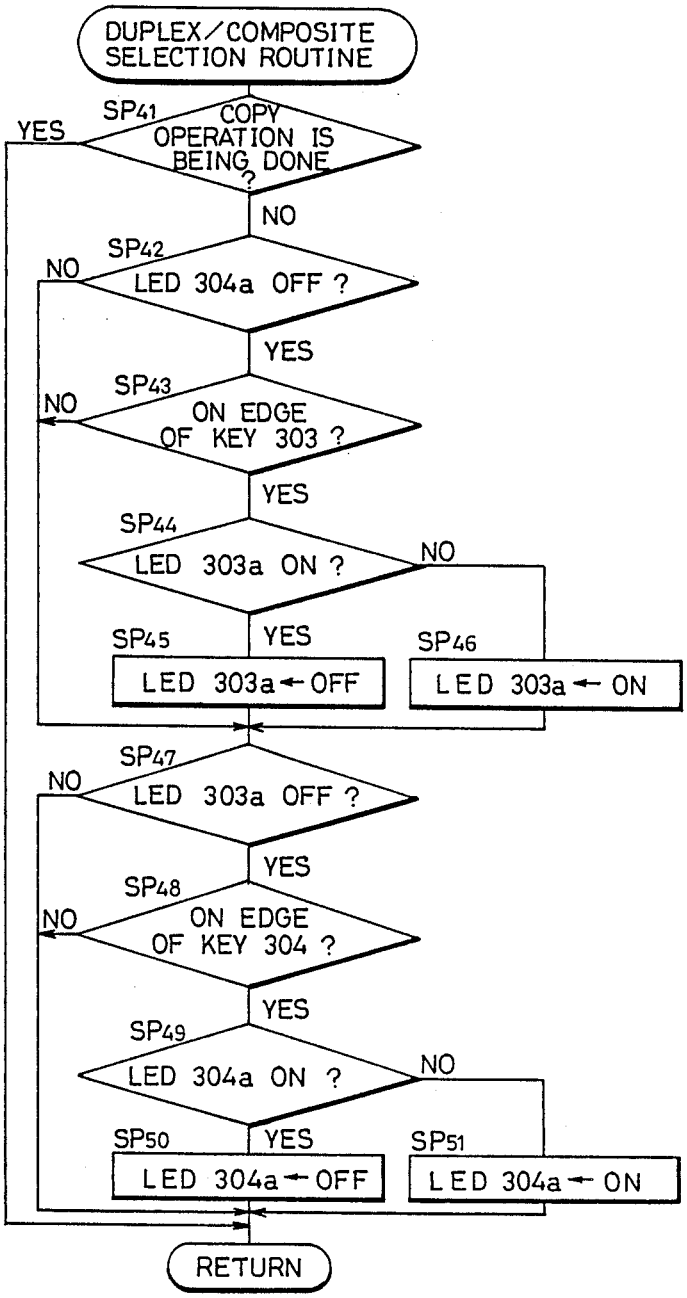
FIG. 8 is a flow chart showing detailed procedures of the duplex/composite selection routine in FIG. 6.

FIG. 8 is a flow chart of the duplex/composite selection routine in FIG. 6.

First, it is determined in step SP41 whether copy operation is being effected or not. If copy operation is being effected, the flow immediately returns.

If copy operation is not being effected, when the duplex copy selection key 303 is pressed in the off state of the composite copy mode selection display LED 304*a*, the duplex copy mode selection display LED 303*a* is turned off if it is in the on state (in steps SP44 and SP45), and it is turned on if it is in the off state (in steps SP44 and SP46). Thus, the on or off state of the duplex copy mode can be changed.

When the composite copy selection key 304 is pressed in the off state of the duplex copy mode selection display LED 303*a*, the composite copy mode selection display LED 304*a* is turned off if it is in the on state (in steps SP49 and SP50) and it is turned on if it is in the off state (in steps SP49 and SP51). Thus, the on or off state of the composite copy mode can be changed.

Figure 9A:
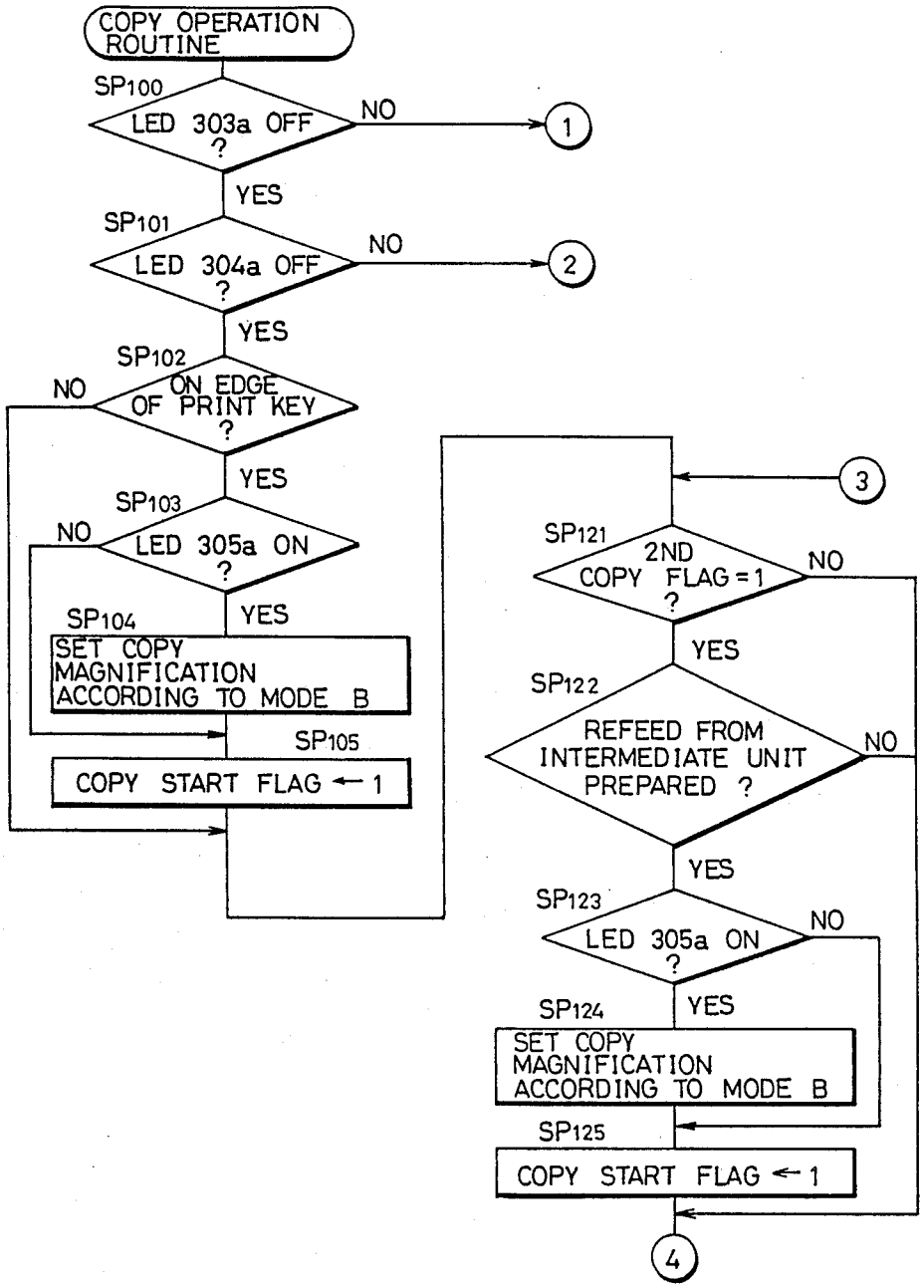
FIGS. 9A to 9E are flow charts showing detailed procedures of the copy operation routine in FIG. 6.
Figure 9B:
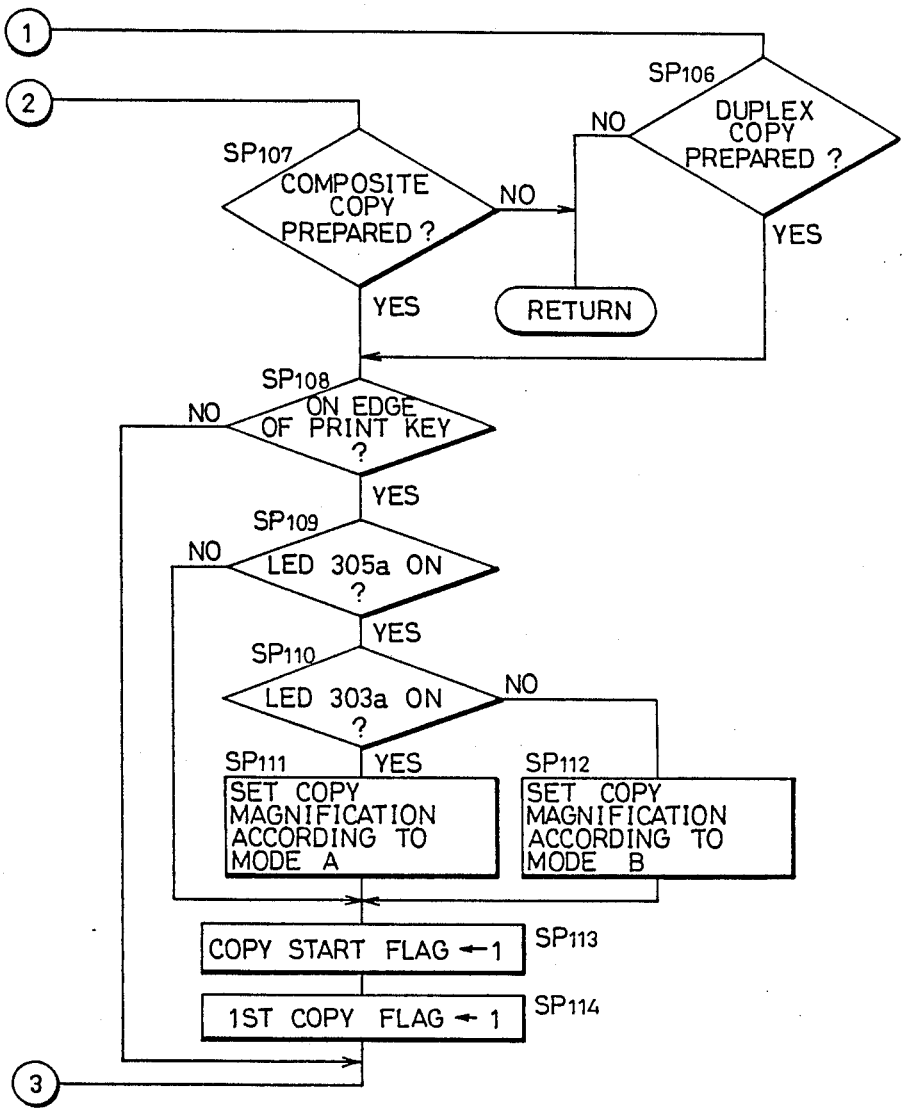
Figure 9C:
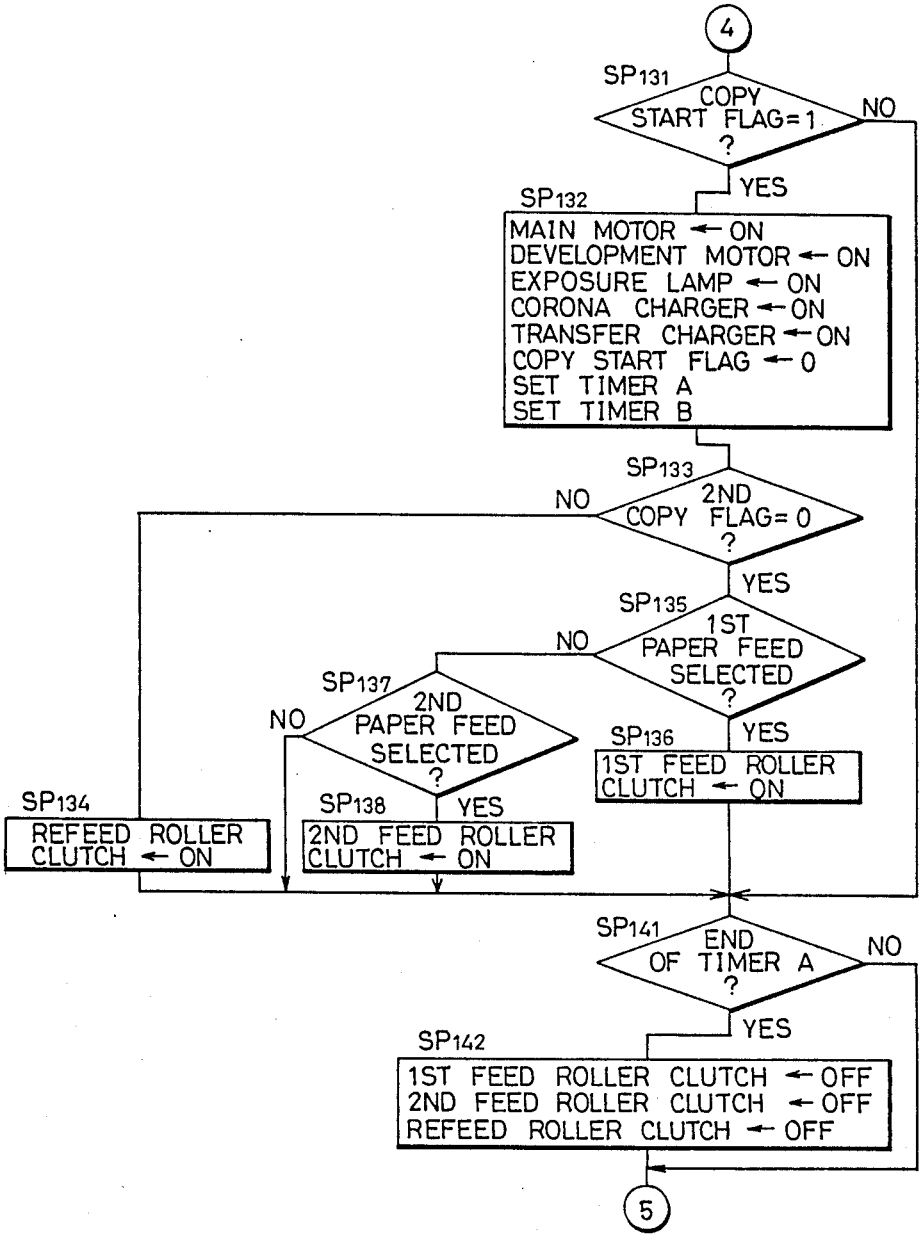
Figure 9D:
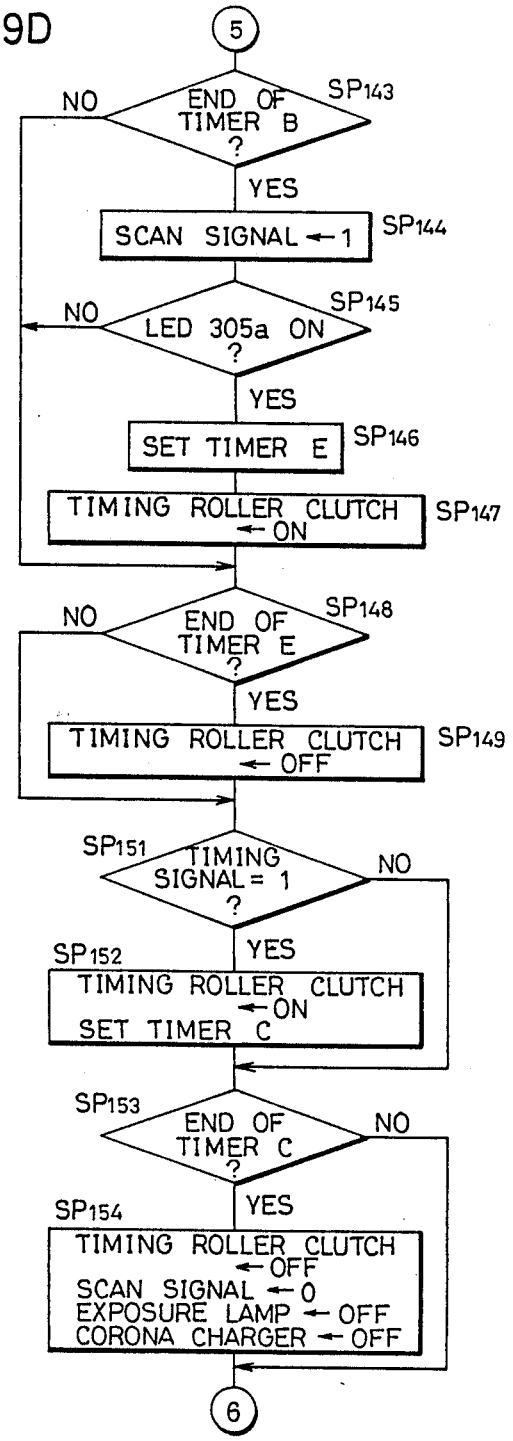
Figure 9E:
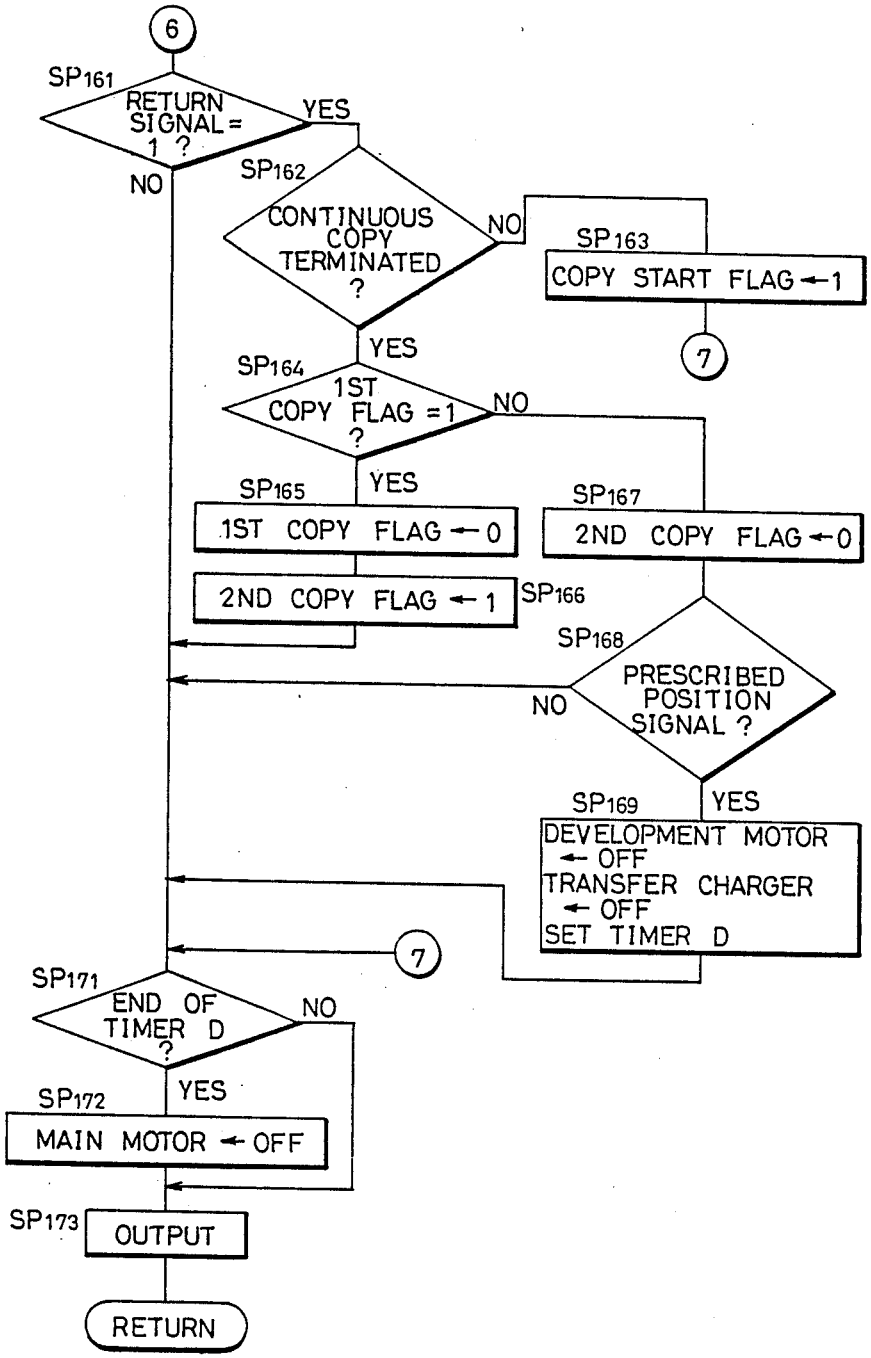

FIGS. 9A and 9E are flow charts showing the copy operation routine in FIG. 6.

First, it is determined in steps SP100 and SP101 whether the duplex copy mode selection display LED 303*a* and the composite copy mode selection display LED 304*a* are both in the off state or not. If those display LEDs are both in the off state, that is, neither the duplex copy mode nor the composite copy mode is selected, it is determined in step SP102 whether an on edge of the print start key 301 is detected or not. If the on edge of the key 301 is detected, the magnification is set according to the mode B of Table 1 (in steps SP103 and SP104) if the automatic reduction mode selection display LED 305*a* is in the on state. Then, a copy start flag is set to "1" in step SP105 and then the processing flow proceeds to step SP121.

If the duplex copy mode or the composite copy mode is selected, NO is determined in step SP100 or SP101 and the processing flow proceeds to step SP106 or SP107. It is determined in step SP106 or SP107 whether the apparatus is prepared for duplex copying or composite copying according to a duplex preparation flag or a composite preparation flag. If the apparatus is prepared for either copying, the flow proceeds to step SP108.

If an on edge of the print start 301 is detected in step SP108, it is determined in step SP109 whether the 20 automatic reduction mode selection display LED 305*a* is on or not. If the display LED 305*a* is on and the duplex copy mode selection display LED 303*a* is on, the magnification is set according to the mode A of Table 1 (in steps SP110 and SP111). If the duplex copy mode selection display LED 303*a* is off, the magnification is set according to the mode B of Table 1 (in steps SP110 and 112).

Subsequently, the copy start flag is set to "1" in step SP113 and a first copy flag is set to "1" in step SP114. Then, the flow proceeds to step SP121.

It is determined in step SP121 whether a second copy flag is "1" or not. If this flag is "1", there is a wait for preparation of refeed from the intermediate tray unit B (in step SP122) and the magnification is set according to the table of the mode B if the automatic reduction mode selection display LED 305*a* is on (in steps SP123 and SP124).

In other words, the magnification is set according to the table of the mode B in step SP124 in the case of a back surface copy in the duplex copy mode and in the case of a second copy copying in the composite copy mode.

Then, the copy start flag is set to "1" in step SP125.

Subsequently, it is determined in step SP131 whether the copy start flag is "1" or not. If this flag is "1", the main motor is driven in step SP132 and the photoreceptor drum 1 is driven to rotate. At the same time, the copy paper transport rollers and the like are enabled.

The exposure lamp 11, the corona charger 3 and the transfer charger 7 are turned on and the development motor is turned on, while the above mentioned copy start flag is reset to "0". Further, the timer A for controlling the feeding system and the timer B for controlling the optical system 10 are set.

Then, it is determined in step SP133 whether the second copy flag is "0" or not. If either the duplex copy mode or the composite copy mode is selected and refeeding of paper is permitted, NO is determined in step SP133 since the second copy flag is set to "1". In step SP134, a refeed roller clutch is turned on so that one sheet of copy paper is refed from the intermediate tray 58. Then, the flow proceeds to step SP141.

On the other hand, when YES is determined in step SP133 at the time of a normal copy process on one surface of copy paper, it is determined in step SP135 whether the first feeding unit is selected or not and it is determined in step SP137 whether the second feeding unit is selected or not. The feed roller clutch of the selected feeding unit is turned on in step SP136 or SP138, so that one sheet of copy paper is fed. Then, the flow proceeds to step SP141.

Subsequently, when an end of the timer A is confirmed in step SP141, the first or second feed roller clutch or the refeed roller clutch is turned off in step SP142.

When an end of the timer B is confirmed in step SP143, a scan signal is applied in step SP144, whereby the optical system 10 effects scanning in the direction of the arrow b in FIG. 1.

If the automatic reduction mode selection display LED 305*a* is on, a timer E is set so that the copy paper projects from the roller pair 13 by the dimension $l_1$ of the leading edge blank area Wf (in step SP146). Then, the timing roller clutch is turned on so that the timing roller pair 13 is rotated (in step SP147).

The set time of the timer E corresponds to a value obtained by dividing the dimension $l_1$ of the leading edge blank area Wf by the rotation speed of the roller pair 13.

At the end of the set time of the timer E, the timing roller clutch is turned off (in steps SP148 and SP149).

Then, it is determined in step SP151 whether a timing signal is applied or not. In other words, it is determined whether a timing switch provided on a scanning locus of the optical system 10 is turned on to start feeding of the copy paper from the timing roller pair 13. If the timing signal is applied, the timing roller clutch is turned on in step SP152 so that the copy paper is sent to the transfer position, and the timer C is set.

When an end of the timer C is confirmed in step SP153, the timing roller clutch, the scanning signal, the exposure lamp and the corona charger 3 are turned off respectively in step SP154.

Subsequently, after a return signal is applied in step SP161, that is, after the optical system 10 begins to return from the scanning end position to the prescribed position, it is determined in step SP162 whether copy operation for the predetermined number of copies is completed or not. In the case of NO in step SP162, the copy start flag is set again to "1" in step SP163. In the case of YES in step SP162, it is determined in step SP164 whether the first copy flag is "1" or not.

The first copy flag is set to "1" when duplex copying or composite copying is executed (as shown in step SP114). In the case of YES in step SP164, the first copy flag is reset to "0" in step SP165 to cancel the duplex copying or the composite copying and the second copy flag is set to "1" in step SP166.

When continuous copy operation is terminated (in the case of YES in step SP162), and if the first copy flag is reset to "0" (in the case of NO in step SP164), the second copy flag is reset to "0" in step SP167. Then, after it is determined in step SP168 as a result of turn-on of the prescribed position switch that the optical system 10 is returned to the movement start position in order to terminate the copy operation, the development motor and the transfer charger 7 are turned off and the timer D is set in step SP169.

Then, when an end of the set time of the timer D is determined in step SP171, the main motor is turned off in step SP172 to stop the rotation of the photoreceptor drum 1. The results of the processing performed till then are outputted in step SP173 and the flow returns to the main routine.

Figure 10:
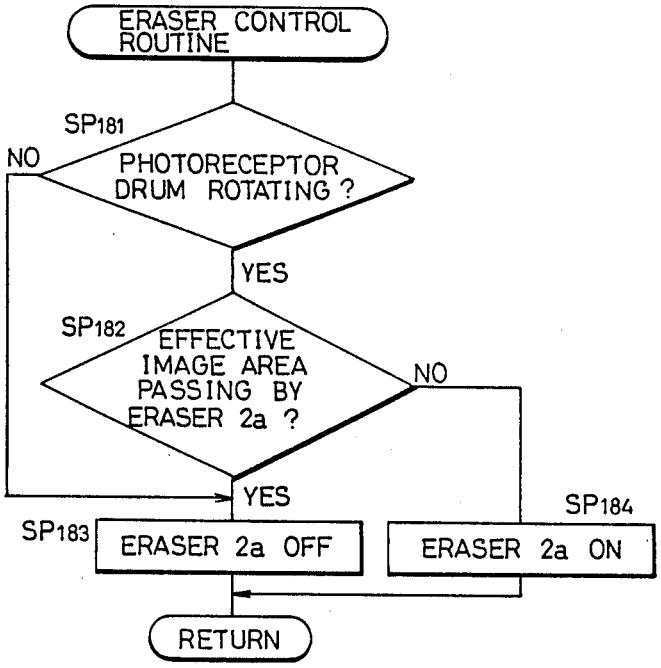
FIG. 10 is a flow chart showing detailed procedures of the eraser control routine in FIG. 6.

FIG. 10 is a flow chart of the eraser control routine in FIG. 6.

It is determined in step SP181 whether the photoreceptor drum 1 is rotating. If the photoreceptor drum 1 is rotating, it is determined whether an effective image area where a latent image of an original image is formed is passing just below the interimage eraser 1*a* (in step SP182).

When the effective image area is passing just below the interimage eraser 2*a*, the interimage eraser 2*a* is turned off (in step SP183). If not, the interimage eraser 2*a* is turned on (in step SP184).

In step SP184, unnecessary latent images formed on the photoreceptor drum 1 are erased and the blank areas Wf and Wr are formed on the leading and rear edges of the copy paper, respectively.

In the above described embodiment, the copy paper P projects from the timing roller pair 13 for the purpose of adjusting the position of the toner image FT on the photoreceptor drum 1 and that of the copy paper P. However, the adjustment of the positions may be effected without projecting the copy paper P by suitably controlling timing of rotation of the timing roller pair 13.

In the above described embodiment, the interimage eraser 2*a* erases the areas for the leading edge blank area Wf and the rear edge blank area Wr so that those areas Wf and Wr can be formed. However, those areas may be formed without using the interimage eraser 2*a*. For example, the leading edge blank area Wf can be formed in a manner in which the copy paper P is sent to the transfer position with a timing earlier than the arrival of the toner image FT by a period corresponding to the dimension of the leading edge blank area Wf. Alternatively, the blank area Wf can be formed by applying light to a white pattern on the rear surface of the document scale by means of the exposure lamp 11 and forming a latent image of the white pattern by the exposure. The rear edge blank area Wr can be also formed by applying light to a white pattern on the rear surface of the document cover by means of the exposure lamp and forming a latent image of the white pattern by the exposure.

In the above described embodiment, the dimensions of the leading edge blank areas Wf and the rear edge blank area Wr, and the magnification in the automatic reduction mode may be set to other suitable values than those described above.

In order to prevent winding of copy paper around the roller or fouling of the rollers due to toner, an original image does not necessarily need to be reduced. For example, in cases where only the central portion of the original image is required to be copied or an image of an original exists only in its central portion, a suitable selection key may be provided, making it unnecessary to effect reduction.

In the above described embodiment, the blank areas are formed on the leading and rear edges of copy paper in the first surface copy of the duplex copy mode and the leading edge blank area is formed on copy paper in the second surface copy. However, blank areas may be formed on leading and rear edges of copy paper although in the second surface copy in the duplex copy mode in the same manner as in the first surface copy.

In addition, in the above described embodiment, the blank areas are formed by combination of the reduction copy process and the use of the eraser. However, the use of the eraser may be omitted if the document cover for the original platen glass is formed by a white material.

According to the present invention, not only in the case of effecting simplex copy but also in the case of effecting duplex copy, copy paper can be prevented from winding around the roller and the roller as well as the copy paper can be prevented from being fouled by toner.

Furthermore, although an image area on copy paper becomes small since the leading edge blank area and the rear edge blank area are provided, the image is formed in a reduced manner on the copy paper and accordingly no deficiency occurs in the image and the content of the original image can be completely reproduced.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A copying apparatus having a photoreceptor, image forming means for forming a toner image on said photoreceptor, transfer means including a transfer portion for transferring the toner image formed on said photoreceptor onto copy paper, fixing means for thermally fixing the toner image transferred on the copy paper, and duplex means for feeding again the thermally fixed copy paper to said transfer portion to form images on both surfaces of the copy paper, comprising:

mode selecting means for selecting a duplex mode for forming images on both surfaces of copy paper, and a simplex mode for forming an image on one surface of copy paper, first means for forming a margin at a leading edge of the copy paper, second means for forming margins at leading and rear edges of the copy paper, and control means for enabling said first means in response to the selection of said simplex mode by said mode selecting means and enabling said second means in response to the selection of said duplex mode by said mode selecting means.

2. A copying apparatus in accordance with claim 1, wherein in response to the selection of the duplex mode by said mode selecting means, an image is formed on a first surface of the copy paper and after that an image is formed on a second surface thereof, and said control means enables said second means at the time of forming the image on said first surface and enables said first means at the time of forming the image on said second surface.

3. A copying apparatus having a photoreceptor, image forming means for forming a toner image corresponding to an original on said photoreceptor with a selected magnification, transfer means for transferring the toner image formed on said photoreceptor onto copy paper, fixing means for thermally fixing the toner image transferred on the copy paper, and duplex means for feeding again the thermally fixed copy paper to the transfer means to form images on both surfaces of the copy paper, comprising:

mode selecting means for selecting a duplex mode for forming images on both surfaces of copy paper, and a simplex mode for forming an image on one surface of copy paper, first means for forming a margin at a leading edge of the copy paper, second means for forming margins at leading and rear edges of the copy paper, and control means for enabling said first means and selecting a first magnification in response to the selection of the simplex mode by said mode selecting means, and enabling said second means and selecting a second magnification in response to the selection of the duplex mode by said mode selecting means.

4. A copying apparatus in accordance with claim 3, wherein said first magnification is a magnification making it possible to form an image of an original in an area of the copy paper excluding the margin formed by said first means, and said second magnification is a magnification making it possible to form an image of an original in an area of the copy paper excluding the margins formed by said second means.

5. A copying apparatus in accordance with claim 4, wherein in response to the selection of the duplex mode by said mode selecting means, an image is formed on a first surface of copy paper and after that an image is formed on a second surface thereon, and said control means enables said second means at the time of forming the image on said first surface and enables said first means at the time of forming the image on said second surface.

6. A copying apparatus having a photoreceptor, image forming means for forming a toner image corresponding to an original on said photoreceptor with a selected magnification, transfer means for transferring the toner image formed on said photoreceptor onto copy paper, fixing means for thermally fixing the toner image transferred on the copy paper, and duplex means for feeding again the thermally fixed copy paper to the transfer means to form images on both surfaces of the copy paper, comprising:

mode selecting means for selecting a duplex mode for forming images on both surfaces of the copy paper, and a simplex mode for forming an image on one surface of the copy paper, and control means for selecting a first magnification in response to the selection of said simplex mode by said mode selecting means, and selecting a second magnification in response to the selection of said duplex mode by said mode selecting means.

7. A copying apparatus in accordance with claim 6, wherein in response to the selection of the duplex mode by said mode selecting means, an image is formed on a first surface of the copy paper and after that an image is formed on a second surface thereof, and said control means selects said second magnification at the time of forming the image on said first surface and selects said first magnification at the time of forming the image on said second surface.

* * * * *

UNITED STATES PATENT AND TRADEMARK OFFICE

CERTIFICATE OF CORRECTION

PATENT NO. : 4,945,386

DATED : July 31, 1990

INVENTOR(S) : Masazumi Ito, et al.

It is certified that error appears in the above-identified patent and that said Letters Patent is hereby corrected as shown below:

In col. 2, line 4, delete "," (comma).

In col. 2, line 15, after "copying", insert --without--.

In col. 5, line 11, after "FIG. 1", insert --)-- (parenthesis).

In col. 5, line 36, before "through", insert --pair--.

In col. 5, line 36, change "tra" to --transport--.

In col. 5, line 57, change "814" to --314--.

In col. 8, line 33, change "9A and 9E" to --9A-9E--.

In col. 9, line 14, delete "copying".

Signed and Sealed this

Seventeenth Day of March, 1992

*Attest:*

*Attesting Officer*

HARRY F. MANBECK, JR.

*Commissioner of Patents and Trademarks*